US007966679B2

(12) United States Patent
Sakata et al.

(10) Patent No.: US 7,966,679 B2
(45) Date of Patent: Jun. 28, 2011

(54) STRETCH ASSISTING CUSHION

(75) Inventors: Naokai Sakata, Tokyo (JP); Hideo Numazawa, Tokyo (JP)

(73) Assignee: Sante Plus, Inc., Tokyo (JP)

( * ) Notice: Subject to any disclaimer, the term of this patent is extended or adjusted under 35 U.S.C. 154(b) by 148 days.

(21) Appl. No.: 12/304,402

(22) PCT Filed: Aug. 1, 2007

(86) PCT No.: PCT/JP2007/065048

§ 371 (c)(1), (2), (4) Date: Apr. 15, 2009

(87) PCT Pub. No.: WO2008/023548

PCT Pub. Date: Feb. 28, 2008

(65) Prior Publication Data

US 2010/0146708 A1 Jun. 17, 2010

(30) Foreign Application Priority Data

Aug. 24, 2006 (JP) ..... 2006-228225

(51) Int. Cl.
*A47C 15/00* (2006.01)
*A63B 26/00* (2006.01)

(52) U.S. Cl. ..... 5/653; 5/630; 482/142

(58) Field of Classification Search ..... 5/630, 633, 5/653, 654; 482/142
See application file for complete search history.

(56) References Cited

U.S. PATENT DOCUMENTS 2,314,080 A * 3/1943 Dine et al. ..... 5/630
3,333,286 A * 8/1967 Biolik ..... 5/632
3,644,949 A * 2/1972 Diamond ..... 5/630
4,592,589 A * 6/1986 Hellwig ..... 297/452.41
4,824,169 A * 4/1989 Jarrell ..... 297/284.1
4,951,334 A * 8/1990 Maier ..... 5/653

(Continued)

FOREIGN PATENT DOCUMENTS

DE 3810980 A1 * 10/1989

(Continued)

OTHER PUBLICATIONS

Standard No. JIS K 6400-2:2004; "Flexible Cellular Polymeric Materials—Determination of the Physical Properties—Part 2: Hardness (Indentation Technique) and Stress-Strain Characteristics in Compression"; Mar. 20, 2004; Japanese Standards Association/The Japan Rubber Manufacturers Association. (Partial English-Language Translation Attached).

(Continued)

*Primary Examiner* — Michael Trettel
(74) *Attorney, Agent, or Firm* — The Webb Law Firm

(57) ABSTRACT

A stretch assist cushion includes an upper member with an upper surface serving as a sitting surface in contact with the user's hip directly or through a covering member covering the upper member, the upper member made of an elastic material; and a lower member located below the upper member and with lower surface serving as a bottom surface in contact with a floor directly or through a covering member covering the lower member, the lower member made of a material harder than the material of the upper member. When the cushion is positioned such that the bottom surface is in contact with the floor, the sitting surface has a predetermined tilt angle relative to the floor, and the lower member determines a predetermined distance between the floor and the lowest point of the sitting surface that has the predetermined tilt angle.

18 Claims, 9 Drawing Sheets

U.S. PATENT DOCUMENTS

| | | | | |
|---|---|---|---|---|
| 5,029,350 | A * | 7/1991 | Edelson | 5/652 |
| 5,134,740 | A * | 8/1992 | Summer | 5/652 |
| 5,431,618 | A * | 7/1995 | Levi | 482/142 |
| 6,523,202 | B2 * | 2/2003 | Loomos | 5/653 |
| 6,578,217 | B1 * | 6/2003 | Roberson | 5/632 |
| 2004/0055091 | A1 * | 3/2004 | Sedan | 5/653 |
| 2008/0313814 | A1 * | 12/2008 | Cheng | 5/655.3 |

FOREIGN PATENT DOCUMENTS

| | | | |
|---|---|---|---|
| JP | 60-195565 | U | 12/1985 |
| JP | 63-8303 | Y2 | 3/1988 |
| JP | 2000-79135 | A | 3/2000 |
| JP | 2000-354526 | A | 12/2000 |
| JP | 2004-223082 | A | 8/2004 |
| JP | 2005-144110 | A | 6/2005 |
| JP | 2005-218818 | A | 8/2005 |

OTHER PUBLICATIONS

Standard No. JIS K 6400-3:2004; "Flexible Cellular Polymeric Materials—Determination of the Physical Properties—Part 3: Resilience"; Mar. 20, 2004; Japanese Standards Association/The Japan Rubber Manufacturers Association. (Partial English-Language Translation Attached).

* cited by examiner

STRETCH ASSISTING CUSHION

BACKGROUND OF THE INVENTION

1. Field of the Invention

The present invention relates to a cushion for use for assisting a user in doing various types of stretching exercises, in particular, to a stretch assisting cushion suitable for use for assisting a user in doing stretching exercise for user's body portion including hip joints.

2. Description of the Related Arts

Currently, it is widely popularized to exercise various types of stretches at sports clubs, at training gyms, or at home according to the health-conscious boom. Among the various types of the stretches, in particular, leg-split type stretching exercises are widely done to stretch person's body portion including hip joints by splitting person's legs because those exercises are suitable for reinforcing the body portion around their joints and are effective for antiaging.

In cases where these leg-split type stretching exercises are done on the floor of the house or on a conventional flat mat/cushion, no appropriate stretching exercise for stretching person's body portion including hip joints can be done because a person's pelvis tends to be inclined rearward and a person's spine is forced to be bent due to an excess stress on the back. This causes a serious problem for, in particular, a person who has a stiff body and an aged person.

Meanwhile, there has been known a simple device for correcting sitting position of lumbar (hereinafter, it will be abbreviated to "lumbar position correction device") (for example, see Japanese Paten Laid-Open Publication 2000-79135) that may be mounted on a sitting surface of a chair and may keep user's pelvis to be inclined forward by correcting sitting position of user's lumbar. To address the above-mentioned problem in which the pelvis tends to be inclined rearward while doing the leg-split type stretching exercises, it will be considered to use the lumbar position correction device, the device being disclosed in Japanese Paten Laid-Open Publication 2000-79135, to keep the pelvis to be inclined forward while doing the stretching exercises.

The lumbar position correction device according to the description of Japanese Paten Laid-Open Publication 2000-79135 includes a main body which is formed in substantially bar-shaped and has a wedge-shaped cross section so that a tilted surface is appeared when the lumbar position correction device is located on the sitting surface of a chair. Thus, when a user sets on the tilted surface of the device located on the sitting surface of the chair, the tilted surface helps user's pelvis to be inclined forward depending on a tilted angle of the surface. However, when the user does leg-split type stretching exercises while this device is located directly on the floor, it is considered that the user cannot do leg-split type stretching exercises appropriately due to the reason mentioned below.

For example, when the lumbar position correction device according to the description of Japanese Paten Laid-Open Publication 2000-79135 is located on the floor and the leg-split type stretching exercises are done, there is only a small distance between the sitting surface formed by the tilted surface of the device and the floor, in particular, an edge line of the tilted surface of the device is substantially the same level as the floor so that it is hard for users to incline their pelvises forward deeply. Accordingly, it is difficult to do appropriate and effective leg-split type stretching exercises.

To secure a necessary level of the sitting surface formed by the tilted surface of the device from the floor, it can be considered that the user does stretching exercises using this lumbar position correction device while the device is mounted on a flat surface of a stretch mat/cushion. However, because the stretch mat/cushion sandwiched between the floor and the device would in general be soft, the sitting surface will incline and become unstable, and thereby making it hard to maintain the tilted angle of the tilted surface of the device such that the users can incline their pelvises forward deeply. Further, the lumbar position correction device may be displaced relative to the stretch mat/cushion located below the device while the user does the stretching exercises using the device so that it becomes difficult to continue the stretching exercises.

SUMMARY OF THE INVENTION

Accordingly, an object of the present invention is to solve the above mentioned problems and to provide a stretch assist cushion which is configured not only to assist users in inclining their pelvises forward deeply for enabling the users to do leg-split type stretching exercises appropriately and effectively, but also to have cost advantage for manufacturing thereof and handling easiness.

In order to solve the above mentioned problems, one aspect of the stretch assist cushion is one for use while doing various types of stretching exercises including a stretching exercise for a user's body portion including a hip joint, comprising:

an upper member that has an upper surface serving as a sitting surface in contact with the user's hip directly or through a covering member covering the upper member, the upper member being made of an elastic material; and a lower member that is located below the upper member and has a lower surface serving as a bottom surface of the cushion in contact with a floor directly or through a covering member covering the lower member, the lower member being made of a material harder than the material of the upper member, wherein, when the cushion is positioned such that the bottom surface is in contact with the floor, the sitting surface has a predetermined tilt angle relative to the floor, and the lower member serves to determine a predetermined distance between the floor and the lowest point of the sitting surface that has the predetermined tilt angle relative to the floor.

DETAILED DESCRIPTION OF THE PREFERRED EMBODIMENTS

General Description

Figure 1:
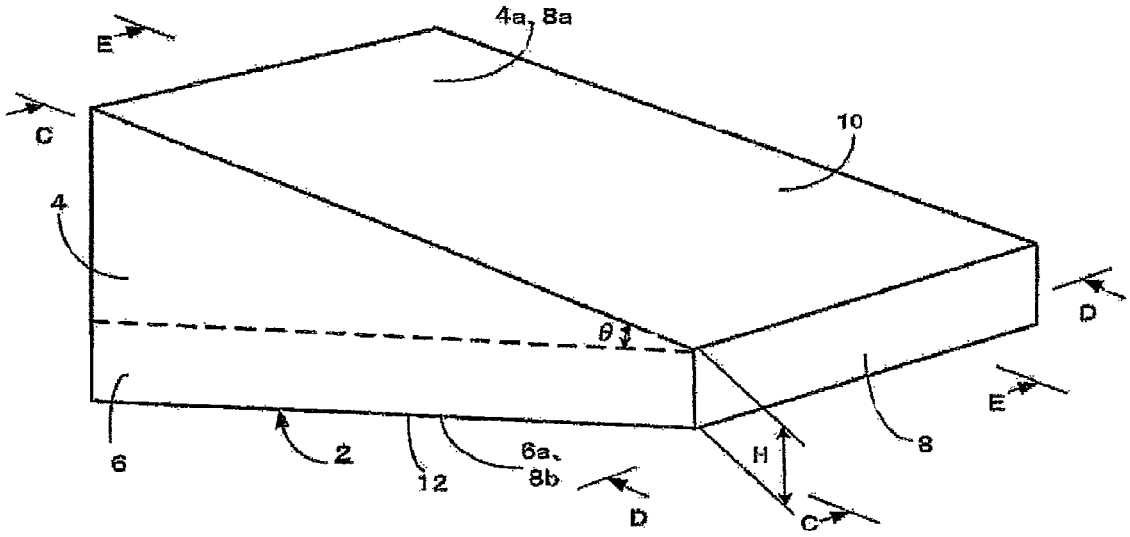
FIG. 1 is a perspective view showing a stretch assist cushion according to one embodiment of the present invention.

A stretch assist cushion according to one embodiment of the present invention is one for use while doing various types of stretching exercises including a stretching exercise for a user's body portion including a hip joint, comprising:

an upper member that has an upper surface serving as a sitting surface in contact with the user's hip directly or through a covering member covering the upper member, the upper member being made of an elastic material; and a lower member that is located below the upper member and has a lower surface serving as a bottom surface of the cushion in contact with a floor directly or through a covering member covering the lower member, the lower member being made of a material harder than the material of the upper member, wherein, when the cushion is positioned such that the bottom surface is in contact with the floor, the sitting surface has a predetermined tilt angle relative to the floor, and the lower member serves to determine a predetermined distance between the floor and the lowest point of the sitting surface that has the predetermined tilt angle relative to the floor.

Here, the wording of the "sitting surface" defines a surface on which a stretch exerciser (herein after it is referred to as a "user") would sits, that is, a surface on which buttocks of the user is to be positioned. The wording of the "bottom surface" defines a surface, when the user employs the stretch assist cushion, which would be in contact with the floor.

Further, the wording of the "an upper surface serving as a sitting surface in contact with the user's hip directly or through a covering member covering the upper member" states that in one case where the upper member is not covered by a covering member, the upper surface of the upper member serves as the sitting surface of the cushion itself, and in another case where the upper member is covered by a covering member, a surface of the covering member that covers the upper surface of the upper member serves as the sitting surface of the cushion. Similarly, the wording of the "a lower surface serving as a bottom surface of the cushion in contact with a floor directly or through a covering member covering the lower member," states that in one case where the upper member is not covered by a covering member, the lower surface of the lower member serves as the bottom surface of the cushion itself, and in another case where the upper member is covered by a covering member, a surface of the covering member that covers the lower surface of the lower member serves as the bottom surface of the cushion.

As to shapes of the upper member and the lower member, for example, it may be considered that the upper member has the shape of wedge having a predetermined tilt angle as a wedge angle, and the lower member has the shape of plate such as rectangle. Further, it may be allowed that the upper member has the shape of plate such as rectangle and the lower member has the shape of wedge having a predetermined tilt angle as a wedge angle, or both the upper member and the lower member are designed to have respective tilt angles.

According to the present embodiment, not only because the sitting surface is tilted to have a predetermined tilt angle relative to the floor, a pelvis of the user can be inclined forward, but also because there certainly be a predetermined distance between the floor and the lowest point of the sitting surface, a sufficient level of the portion of the sitting surface can be obtained regardless of the position of the sitting surface at which the user sits, thereby ensuring appropriate and effective stretching exercises. Further, because a material of the lower member is harder than that of the upper member, the sitting surface does not vacillate so that the cushion surely obtains its positional stability.

Further, because the stretch assist cushion according to the present embodiment has a simple structure, it is possible to provide the stretch assist cushion that can be manufactured with low cost, and has light weight and handling easiness.

Another embodiment of the stretch assist cushion according to the present invention provides the stretch assist cushion having a sitting surface which is designed such that the predetermined tilt angle thereof has the value within range from 15 to 25 degrees.

When the predetermined tilt angle is set to be within range from 15 to 25 degrees according to the present embodiment, it is possible to minimize a risk that the buttocks of the user slide on the sitting surface, and user's pelvis can be inclined forward deeply. Therefore, the users can do leg-split type stretching exercises for stretching their body portions including hip joints appropriately and effectively.

Another embodiment of the stretch assist cushion according to the present invention provides a stretch assist cushion having the upper member having the value of hardness within range from 200 N to 500 N defined by Japanese Industrial Standard JISK6400-2.

In the present embodiment where the upper member having the value of hardness within range from 200 N to 500 N defined by Japanese Industrial Standard JISK6400-2, it can be provided a stretch assist cushion having the upper member having the sitting surface in which, when the user sits on the sitting surface, the sitting surface will not be over depressed, and a risk that the buttocks of the user may slide on the sitting surface can be minimized.

Another embodiment according to the present invention provides a stretch assist cushion having the upper member having the value of hardness within range from 250 N to 450 N defined by Japanese Industrial Standard JISK6400-2.

In the stretch assist cushion according to the present embodiment, the upper member having the value of hardness within range from 250 N to 450 N defined by Japanese Industrial Standard JISK6400-2. Hence, from the viewpoint of a risk of occurrence of over depression of the sitting surface and occurrence of user's slide on the sitting surface, it can be provided a stretch assist cushion suitable for various types of physique of the user.

Another embodiment according to the present invention provides a stretch assist cushion in which the predetermined distance between the floor and the lowest point of the sitting surface having the predetermined tilt angle relative to the floor has the value within range from 5 to 100 mm.

In the stretch assist cushion according to the present embodiment, because the predetermined distance between the floor and the lowest point of the sitting surface that has the predetermined tilt angle relative to the floor is within range from 5 to 100 mm, even when the user sits on a portion of the sitting surface which has nearly the lowest level, the user can do the stretching exercises appropriately and effectively.

Another embodiment according to the present invention provides a stretch assist cushion having the upper member which is made of a foam or a flexible foam constituted of a synthetic resin including polyurethane, rubber, or polypropylene.

By virtue of use of such a material for the upper member of the stretch assist cushion according to the present embodiment, the upper member of the stretch assist cushion with a light weight and an appropriate elasticity can be manufactured with a low manufacturing cost.

Another embodiment according to the present invention provides a stretch assist cushion having the upper member which has the value of the impact resilience within range from 20 to 60% defined by Japanese Industrial Standard JISK6400-3.

Because the upper member has such a value of the impact resilience as shown in the present embodiment, it can be provided the stretch assist cushion in which, when the user sits on the sitting surface, the sitting surface will not be over depressed, and a risk that the buttocks of the user may slide on the sitting surface can be minimized.

Another embodiment according to the present invention provides a stretch assist cushion having the upper member which is formed to have the shape of rectangular or square in the top view and have the shape of triangular or trapezoid in the side view, and having the lower member which is formed to have the shape of rectangular or square in the top view and have the shape of triangular or trapezoid in the side view.

According to the present embodiment, the upper member and the lower member can be combined with each other to provide the stretch assist cushion which enables the user to do the stretching exercises effectively and which can be manufactured with low cost.

Another embodiment according to the present invention provides a stretch assist cushion in which, when the stretch assist cushion is positioned such that the bottom surface is in contact with a floor, the crest of the sitting surface is located at a rear end of the cushion or at the position before a rear end of the cushion.

When the users do the stretching exercises using the stretch assist cushion according to the present invention, the users sit on the cushion such that their backs face a direction in which the level of the tilted sitting surface is higher. In this case, the wording of "a rear end of the cushion" defines an end of the cushion to which the back of the user who does the stretching exercises faces. In the present embodiment, there is a case where the crest of the tilted sitting surface is positioned at the rear end of the cushion and another case where the crest of the tilted sitting surface is positioned before the rear end of the cushion. In the former case where the crest of the sitting surface is positioned at the rear end of the cushion, the stretch assist cushion can be designed to have a simple shape, and the sitting surface thereof in general can be positioned at higher level from the floor. However, if the cushion is designed to have a short distance between the front and rear ends of the cushion, there is a risk that the user may fall down backward when the user sits on the sitting surface near the crest of the cushion. In this case, it is preventable that the user falls down backward by making the crest of the sitting surface positioned before the rear end of the cushion. Therefore, in the cushion according to the present embodiment, the most suitable shape of the cushion can be selected among those depending on size of the cushion, using conditions of the cushion, and the like.

Another embodiment according to the present invention provides a stretch assist cushion being sized to have 300 to 500 mm in length and 300 to 500 mm in width in the top view image of the cushion.

According to the present embodiment, it can be provided a stretch assist cushion which has handling easiness, light weight, and storing easiness.

Another embodiment according to the present invention provides a stretch assist cushion having the sitting surface and/or the bottom surface treated so as to increase the value of the friction coefficient thereof.

According to the present embodiment, because the sitting surface and/or the bottom surface is treated so as to increase the value of the friction coefficient thereof, the user can do the stretching exercises appropriately and effectively without felling a risk that the user's buttocks will slide on the sitting surface.

Another embodiment according to the present invention provides a stretch assist cushion when the cushion is arranged such that the bottom surface is in contact with the floor and the same load is applied onto each portion of the sitting surface having the predetermined tilt angle relative to the floor, a depression value of a first portion located at a higher level from the floor than a second portion is larger than a depression value of the second portion.

When the user sits on the portion of the sitting surface that is located near the lowest point of the sitting surface, a distance between the floor and the depressed portion of the sitting surface on which the user sits is relatively short. Therefore, in this case, if the depression value is large, the user tends to feel that it is hard to do the stretching exercises. In contrast to this case, when the user sits on the portion of the sitting surface that is located near the highest point of the sitting surface, a distance between the floor and the depressed first portion of the sitting surface on which the user sits is relatively long. Therefore, in this case, if a depression value is small, the user tends to feel a risk that the user's buttocks will slide on the sitting surface.

Therefore, it is possible to provide a stretch assist cushion that is in conformity with the user's feeling and easy for handling by making a depression value of a first portion located at a higher level from the floor is larger than that of the second portion located at lower level.

Another embodiment according to the present invention provides a stretch assist cushion in which, when the same load is applied onto each portion of the sitting surface, the depression value of each portion of the sitting surface varies substantially proportionally with a difference of a level from the floor.

According to the present embodiment, because the depression value of each portion of the sitting surface varies substantially proportionally with a difference of a level from the floor, it is possible to provide a stretch assist cushion that is in conformity with the user's feeling and easy for handling. Further, because the stretch assist cushion according to the present embodiment can be manufactured in a manner in which the upper member is formed in the shape of wedge and the lower member is formed in the shape of rectangular, it can be realized as a simple structure with low manufacturing cost.

Another embodiment according to the present invention provides a stretch assist cushion that has the upper member having hardness such that, when the user sits on around the crest of the sitting surface having the predetermined tilt angle relative to the floor, a depression value is within range from 10 to 30 mm.

In the present embodiment, it can be provided the stretch assist cushion such that the sitting surface is not over depressed, and a risk that the user's buttocks will slide on the sitting surface is minimized by providing the upper member with hardness such that a depression value is within range from 10 to 30 mm when the user sits on around the crest of the sitting surface.

Another embodiment according to the present invention provides a stretch assist cushion that, when the height of the user is L, has a predetermined distance between the floor and the lowest point of the sitting surface that has the predetermined tilt angle relative to the floor has the value within range from $0.4 \times L \times \sin 3°$ to $0.6 \times L \times \sin 6°$.

In the present embodiment, the user can do the stretching exercises appropriately and effectively even when any user having various types of physique sits on around the crest of the sitting surface to do stretching exercises by determining the distance between the floor and the lowest point of the sitting surface based on the physique of the user.

Another embodiment according to the present invention provides a stretch assist cushion having means for changing the value of the hardness of the stretch assist cushion.

The "means for changing the value of the hardness of the stretch assist cushion" includes, for example, as will be described later, means to fill the interior cavity made in the stretch assist cushion with air. Further, the "means for changing the value of the hardness of the stretch assist cushion" includes means to fill the interior of the stretch assist cushion with a gel-type material whose curing condition changes according to parameters such as temperature and the like. Any other means for changing the value of the hardness of the stretch assist cushion can also be utilized.

Therefore, the present embodiment can provide the stretch assist cushion having the optimum value of the hardness for the physique or purposes of the user because the stretch assist cushion includes the means for changing the value of the hardness thereof.

Another embodiment according to the present invention provides a stretch assist cushion in which an interior cavity of the upper member and/or an interior cavity of the lower member be filled with air, and the value of the hardness of the cushion can be changed by adjusting a pressure of the filled air.

In the present embodiment, the upper member and/or the lower member of the stretch assist cushion is designed to have interior cavities/cavity, and the value of the hardness of the cushion can be changed by adjusting its interior pressure.

Though the interior cavity/cavities of the upper member/lower member is filled with air in the present embodiment, means for changing the value of the hardness of the stretch assist cushion should not be limited to that, and the interior cavity/cavities would be allowed to be filled with rare gases, liquids, and other fluids.

Another embodiment according to the present invention provides a stretch assist cushion in which a foam constituted of a synthetic resin is further inserted into the interior cavity/cavities of the upper member or/and the interior cavity of the lower member in addition to the air so as to change the value of the hardness of the cushion by combining the filled air with the foam in the interior cavity of the upper member and/or the interior cavity of the lower member.

According to the present embodiment, it can be provided a stretch assist cushion that has hardness such that the user can do the stretching exercises comfortably, and the hardness can be adjusted by combining the filled air with the foam.

Another embodiment according to the present invention provides a stretch assist cushion having means for changing the value of a distance between the floor and the lowest point of the sitting surface having the predetermined tilt angle relative to the floor.

The "means for changing the distance between the floor and the lowest point of the sitting surface" is exemplified by means in which the cushion can be detachably provided with a member for height adjustment on the bottom surface of the stretch assist cushion. When the lower member has an interior cavity therein, it would be allowed that the interior cavity of the lower member is occupied with an amount of fluid to adjust the height of the lowest point of the sitting surface to the predetermined one. Further, it would be allowed that the stretch assist cushion is provided with an apparatus for adjusting height mechanically. However, any other means for changing height can be utilized According to the present embodiment, because the stretch assist cushions provided with the means for changing the distance between the floor and the lowest point of the tilted sitting surface, the distance can always be adjusted to an optimum one that is determined by physique of the user and/or flexibility of the user.

As mentioned above, in the stretch assist cushion according to the present invention, because the sitting surface is tilted to have a predetermined tilt angle relative to the floor, pelvis of the user can be inclined forward regardless of a portion of the sitting surface at which the buttocks of the user is positioned, and because there certainly be a predetermined distance between the lowest point of the sitting surface and the floor, there can be obtained a sufficiently large value of the level from the floor of the area of the sitting surface at which the user sits. Therefore, the user can do appropriate and effective stretching exercises by using the stretch assist cushion according to the present embodiment. Further, because the first material of which the lower member is made is harder than the second material of which the upper member is made, the sitting surface can be prevented from being vacillated so that the cushion surely obtains its positional stability.

Further, because the stretch assist cushion according to the present embodiment has a simple structure, it is possible to provide the stretch assist cushion that can be manufactured with low cost and has light weight and handling easiness.

Further, it is possible to provide a stretch assist cushion that is in conformity with the user's feeling and easy for handling by making a depression value of a first portion located at a higher level from the floor larger than that of the second portion located at a lower level.

Further, it can be provided the stretch assist cushion such that the sitting surface is not over depressed, and a risk that the user's buttocks will slide on the sitting surface is minimized by providing the upper member with adequate hardness.

Description of the Illustrated Embodiment

In the following, referring to the attached drawings, a whole structure of one of the embodiments of a stretch assist cushion according to the present invention will be described in detail.

(Description of the Whole Structure of the Stretch Assist Cushion)

Figure 2A:
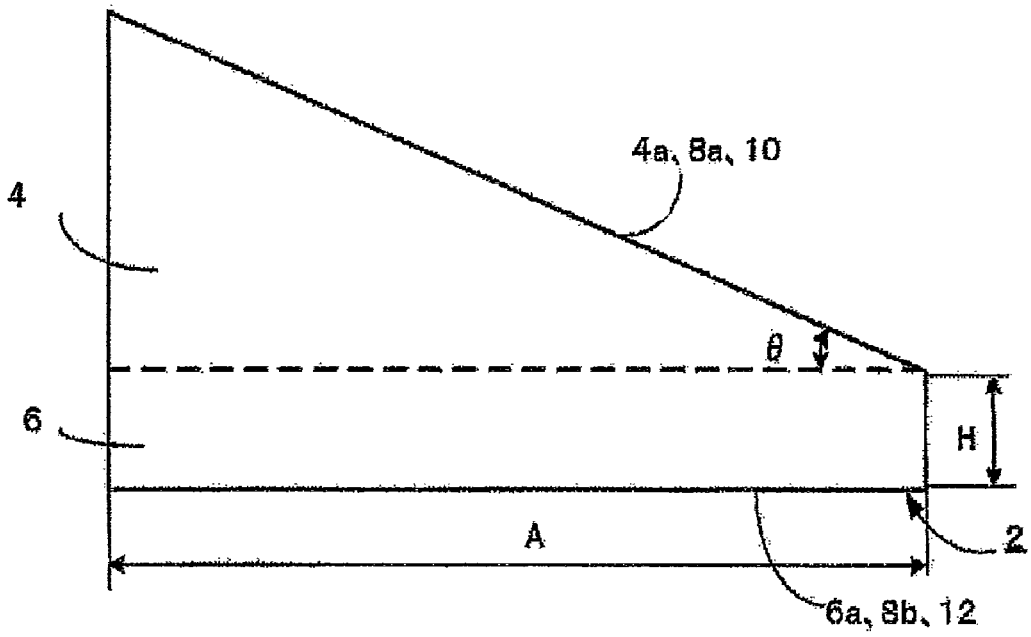
FIG. 2*a* is a side elevational view of the stretch assist cushion shown in FIG. 1, taken in the direction of arrow C shown in FIG. 1.
Figure 2B:
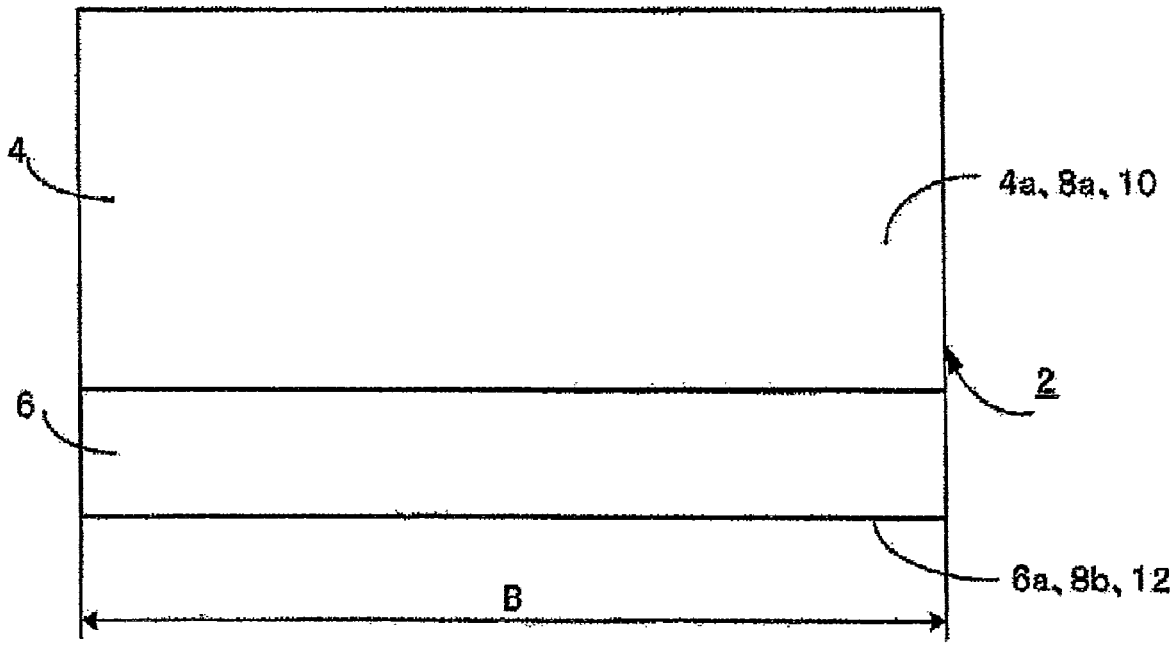
FIG. 2*b* is a side elevational view of the stretch assist cushion shown in FIG. 1, taken in the direction of arrow D shown in FIG. 1.

First, as to the one of the embodiments of stretch assist cushions according to the present invention, the whole structure of a stretch assist cushion will be explained. FIG. 1 is a perspective view showing a stretch assist cushion according to one embodiment of the present invention. FIG. 2*a* is a side elevational view of the stretch assist cushion taken in the direction of arrow C shown in FIG. 1, and FIG. 2*b* is a side elevational view of the stretch assist cushion taken in the direction of arrow D shown in FIG. 1. Further, FIG. 3 is a side elevational view of the stretch assist cushion taken in the direction of arrow E shown in FIG. 1.

The stretch assist cushion 2 according to the present invention mainly constituted of an upper member 4 that has an upper surface 4*a* and is formed in the shape of wedge, a lower member 6 that is positioned below the upper member 4, has a lower surface 6*a* and is formed in the shape of rectangular, and a cover member 8 that covers an exterior surface of the upper member 4 and the lower member 6. The upper member 4 is made of a first material which has elasticity while the lower member 6 is made of a second material which is harder than the first material. In the present embodiment, a first contact surface 4*b* and a second contact surface 6*b* (see FIG. 3) are in contact with each other so that the upper member 4 and the lower member 6 are connected with each other.

A portion of the cover member 8 which covers the upper surface 4*a* of the upper member 4 is defined as an upper surface cover 8*a*. While the stretch assist cushion 2 is in use, the user sits on the upper surface cover 8*a*, that is, the upper surface cover 8*a* serves as a sitting surface 10 of the cushion 2 such that the sitting surface 10 is in contact with buttocks of the user. Further, the portion of the cover member 8 which covers the lower surface 6*a* of the lower member 6 is defined as a lower surface cover 8*b*. While the stretch assist cushion 2 is in use, the lower surface cover 8*b* serves as a bottom surface 12 of the cushion 2 such that the bottom surface 12 is in contact with a floor.

Figure 3:
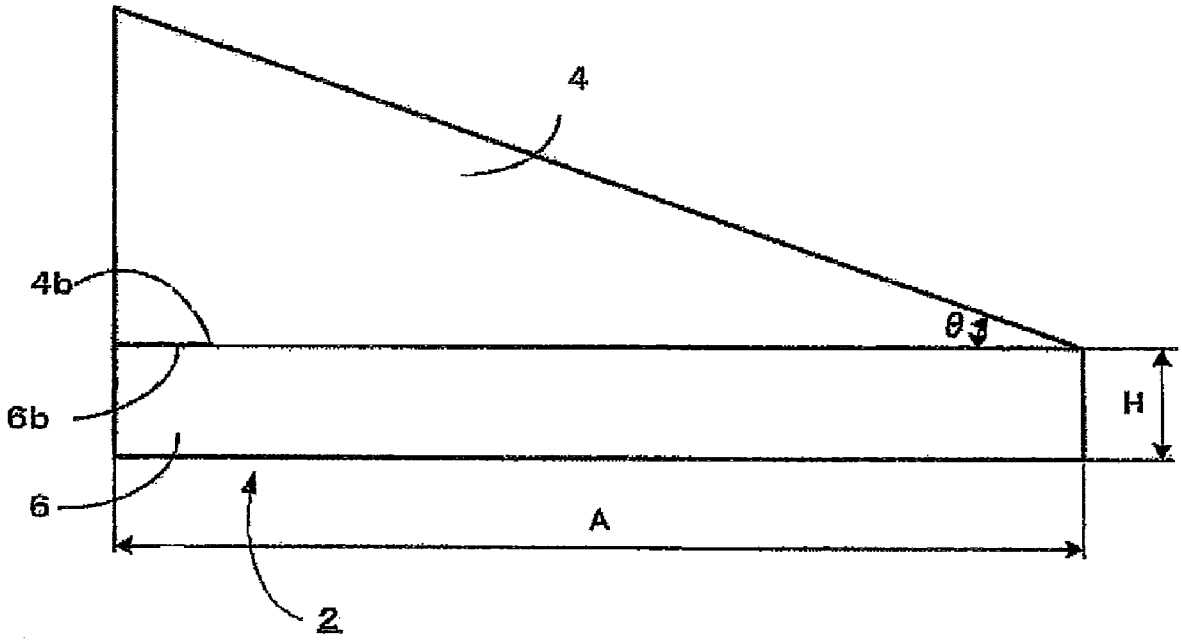
FIG. 3 is a side elevational view of the stretch assist cushion shown in FIG. 1, taken in the direction of arrow E shown in FIG. 1.

In the embodiment shown in FIGS. 1-3, the upper member 4 and the lower member 6 are covered by the cover member 8. However, the configuration of the stretch assist cushion 2 is not limited to the present embodiment, that is, it is considered to be allowed that an embodiment provides a stretch assist cushion having the upper member and the lower member 6 which are directly in contact with buttocks of the user and the floor, respectively, without the cover member 8. Hence, hereinafter, regardless of whether the cover member 8 is provided or not, a portion of the surface with which user's buttocks is in contact, i.e., the upper surface 4*a* of the upper member 4 or the upper surface cover 8*a*, will be referred to as the sitting surface 10 of the cushion, and another portion of the surface with which the floor is in contact, i.e., the lower surface 6*a* of the lower member 6 or the lower surface cover 8*b*, will be referred to as the bottom surface 12 of the cushion.

In the following explanations, because the cover member 8 is made of thin material, it will be understood that the thickness of the cover member 8 can be neglected. Hence, the external dimensions of the stretch assist cushion 2 are recognized as those of the upper member 4, those of the lower member 6, or as the sum of those of the upper member 4 and the lower member 6.

With reference to the external dimensions of the stretch assist cushion 2 shown in FIGS. 1-3, the length A is 40 mm, the width B is 400 mm, and the level H of the lowest point of the sitting surface 10 that is tilted to have the predetermined tilt angle relative to the floor is 50 mm. While any values of the length A and the width B may be allowed in accordance with user's purposes, it is preferable that the stretch assist cushion is sized to have 300 to 500 mm in the length A and 300 to 500 mm in the width B which are suitable for physique of the majority of user and for easiness for carrying and storage of the stretch assist cushion. For example, a stretch assist cushion can be provided for a child, a boy, a girl, or a woman, which has 325 mm in the length A and 300 mm in the width B.

There are some cases where it would be preferable that the cushion is considered to be sized such that the minimum value of the level H of the lowest point of the sitting surface 10 is equal to or greater than 5 mm, equal to or greater than 15 mm, or equal to or greater than 30 mm, and the maximum value of the level H of the lowest point of the sitting surface 10 is equal to or less than 100 mm, equal to or less than 150 mm, or equal to or less than 200 mm. The reasons of these preferable values of the level H of the lowest point of the sitting surface 10 will be explained below.

Further, the sitting surface 10 is tilted relative to the bottom surface to have the tilt angle θ. In the embodiment shown in FIGS. 1-3, the tilt angle θ is 20 degrees. Hence, when the stretch assist cushion 2 is arranged such that the bottom surface 12 is in contact with the floor, a first value of the level of the sitting surface 10 at the lowest point H which is shown at right side of the sheet in FIG. 2*a* (hereinafter, it will be referred to as a "front end side") is 50 mm and a second value of the level of the sitting surface 10 at the highest point which is shown at left side of the sheet in FIG. 2*a* (hereinafter, it will be referred to as a "rear end side") is about 200 mm (=50 mm 400 mm×tan 20°). Therefore, in the present embodiment, the sitting surface 10 is ensured to have a sufficient value of the level from the floor even at the lowest point thereof. The explanation regarding a preferable value of the tilt angle θ will be given below.

In the embodiment shown in FIGS. 1-3, top views of both of the upper member 4 and the lower member 6 have shapes of square. However, it is allowed that both the top views of the upper member 4 and the lower member 6 have shapes of rectangular. Further, in the embodiment shown in FIGS. 1-3, a side elevational view of the upper member 4 has shape of triangle. However, it is allowed that the side elevational view of the upper member 4 has shape of trapezoid. While, in the embodiment shown in FIGS. 1-3, a side elevational view of the lower member 6 has shape of rectangular, it is allowed that the side elevational view of the lower member 6 has shape of triangle having a tile angle, or trapezoid.

(Detail Description of Structure of the Upper Member 4)

Next, a structure of the upper member 4 will be described in further detail. The upper member 4 is made of the first material having elasticity. Specifically, in the embodiment shown in FIGS. 1-3, a foam constituted of polyurethane is adopted as the first material. However, the first material is not limited to such the material, and a foam or a flexible foam constituted of a synthetic resin exemplified by polyurethane, rubber, or polypropylene can be adopted as the first material. The preferable value of the hardness of the upper member 4 which has elasticity will be explained below.

(Detail Description of Structure of the Lower Member 6)

Next, a structure of the lower member 6 will be described in further detail. The lower member 6 is made of the second material having elasticity harder than that of the first material. Specifically, in the embodiment shown in FIGS. 1-3, a foam constituted of polyethylene is adopted as the second material. However, the second material is not limited to such the material, but a foam or a flexible foam constituted of a synthetic resin exemplified by polyurethane, rubber, or polypropylene or chip urethane may be adopted as the second material. Further, wood, plastics, or metal can be used as the second material.

Regarding the value of the hardness of the lower member 6, a value of the hardness with a wide range can be accepted if such value is larger than that of the upper member 4. However, it would be preferable that the value of hardness of the second material is chosen so as to have a very small amount of deformation of the lower member 4 when the user sits on the cushion 2. Because the lower member 6 is harder than the upper member 4, a load on the cushion when the user sits on the cushion, tends to be widely distributed so that stability of the cushion 2 can be ensured when the user sits on the stretch assist cushion 2 to do stretching exercises.

(Description of a Method for Connecting the Upper Member 4 and the Lower Member 6 Together)

In the embodiment shown in FIGS. 1-3, as shown in FIG. 3, the upper member 4 and the lower member 6 are connected together via the first contact surface 4*b* and the second contact surface 6*b*. Specifically, an adhesive may be used to connect the upper member 4 and the lower member 6 together. However, the method for connecting the upper member 4 and the lower member 6 is not limited to this method, but other possible methods for connecting the upper member 4 and the lower member 6 would be allowed, for example, a method in which the upper member 4 having elasticity is fitted into the lower member 6 harder than the upper member 4 to connect these together.

Further, when the cover member 8 has sufficient strength, the upper member 4 and the lower member 6 are not directly connected together so that only the cover member 8 is employed for keeping the upper member 4 and the lower member 6 in contact with each other.

(Description of Structure of the Cover Member 8)

Next, a structure of the cover member 8 will be described in further detail. In the embodiment shown in FIGS. 1-3, the cover member 8 is made of artificial leather. However, the material of which the cover member 8 is made is not limited to such the material, and other material such as natural leather, synthetic leather, artificial fiber, and natural fiber would be allowed to be used.

The cover member 8 has several surfaces including the upper surface cover 8*a* and the lower surface cover 8*b*, and, in particular, the upper surface cover 8*a* and the lower surface cover 8*b* are taken by measures to increase values of their friction coefficient so as to prevent buttocks of the user from sliding on the upper surface cover 8*a* or prevent the lower surface cover 8*b* from sliding from the floor. In the embodiment shown in FIGS. 1-3, the upper surface cover 8*a* has been subjected to a roughing process or a process for forming a fine scabrous surface to generate a sufficient friction force between the upper surface cover 8*a* and user's buttocks. Similarly, the lower surface cover 8*b* of the cover member 8 has also been subjected to a roughing process or a process for forming a fine scabrous surface to generate a sufficient friction force between the lower surface cover 8*b* and the floor. However, means for increasing the friction coefficient of the surface of the cover member 8 is not limited to such methods as mentioned above, but other possible means for increasing the friction coefficient can be applied.

(Description of Tilt Angle θ of the Sitting Surface)

Figure 4A:
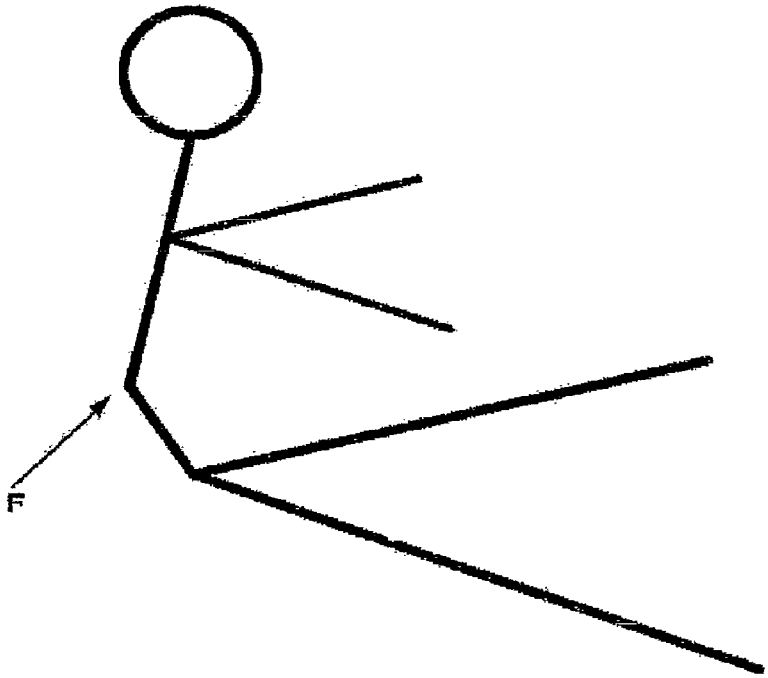
FIG. 4*a* is a schematic diagram illustrating a condition in which a user does leg-split type stretching exercises while sitting on a floor or a flat mat/cushion or not using the stretch assist cushion according to the present invention.

Next, referring to FIGS. 4*a* and 4*b*, the tilt angle θ by which the sitting surface 10 of the stretch assist cushion 2 according to the present invention is tilted will be explained in detail. FIG. 4*a* is a schematic diagram illustrating a condition in which the user does leg-split type stretching exercises while the user sits on a floor or a flat mat/cushion and FIG. 4*b* is a schematic diagram illustrating a condition in which the user does the leg-split type stretching exercises while the user sits on the stretch assist cushion 2 according to the present invention.

In the case where the user does leg-split type stretching exercises while the user sits on the floor or a flat mat/cushion, as indicated by the arrow F in FIG. 4*a*, pelvis of the user is inclined backward, that is, the user have to be postured such that an angle between the floor and the pelvis of the user exceeds 90 degrees. In such user's posture, stress would be concentrated on the pelvis of the user so that it is difficult for the users to do stretching exercises around their hip joints sufficiently.

Figure 4B:
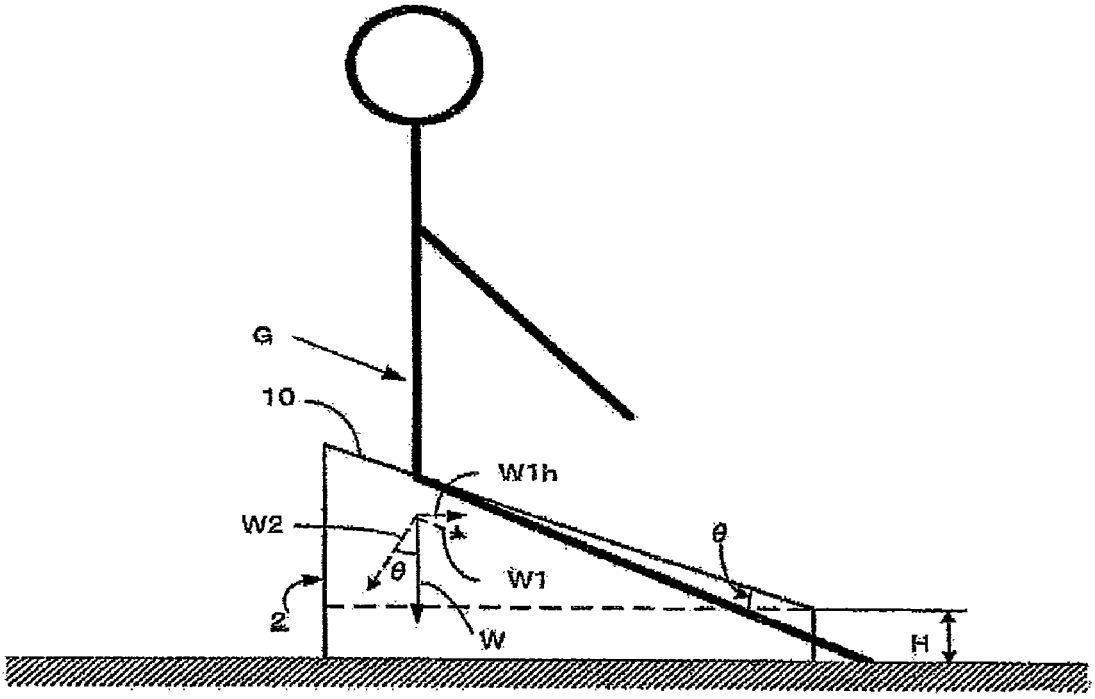
FIG. 4*b* is a schematic diagram theoretically illustrating an effect of the stretch assist cushion according to the one embodiment of the present invention, which assists the user in inclining user's pelvis forward.

In the case where the user does leg-split type stretching exercises using the stretch assist cushion 2 according to the present invention, as indicated in FIG. 4*b*, a load W generated by gravity subjecting to the user in the vertical direction can be decomposed as a sum of a first component W1 in the direction along the sitting surface 10 (that is, in the direction along a tiled surface with the tilt angle θ) and a second component W2 in the direction perpendicular to the sitting surface. In this case, the first component W1 includes a third component W1*h* in the horizontal direction (in the direction parallel to the floor).

These relations can be expressed in mathematical formulae as follows:

$$W1 = W \times \sin\theta$$

and $$W1h = W \times \sin\theta \times \cos\theta.$$

Therefore, as indicated by the arrow G in FIG. 4*b*, the third component W1*h* may assist the user inclining user's buttocks forward so that an angle of user's buttocks relative to the floor can be reduced to the value equal to or smaller than 90 degrees.

When the value of the tilt angle θ is too small to generate a sufficient value of the third component W1*h*, the users cannot incline their buttocks forward enough. In contrast to this, when the value of the tilt angle θ is too large, the value of the first component W1 parallel to the sitting surface is also increased and becomes too large so that there is a high risk that buttocks of the user slide on the sitting surface. As can be seen from the above formulae, as the tilt angle θ is increased, a difference between the values of the first component W1 and the third component W1*h* is also increased. Hence, when the value of the tilt angle θ is too large, a sliding force to make buttocks of the user slide becomes larger than a horizontal component to incline the user's pelvis forward so that a situation not preferable for stably doing stretching exercises may be realized.

According to test results obtained by performing tests in which a plurality of examiners having difference in sex, age, physique and the like have tested a plurality of prototypes of the stretch assist cushion, each of which has an individual tile angle θ, it has been concluded that a preferable value of the tilt angle θ is within range from 10 to 30 degrees, in particular, within range from 15 to 25 degrees.

Here, in a case where a cushion has the tilt angle θ of 20 degrees, when it is presumed that the value of the load W of a typical woman will be 400 N, that of a typical man will be 550 N, and that of a heavy man will be 700 N, the values of the third component W1*h* that can cause pelvis of the user to be inclined forward and the first component W1 that can cause the user's buttocks to slide on the sitting surface are calculated as specified in the table shown below.

TABLE 1

| LOAD W | Horizontal Component W1h | Component parallel to Sitting Surface W1 |
|---|---|---|
| W = 400N (A Typical Woman is assumed) | 137N | 129N |
| W = 550N (A Typical Man is assumed) | 188N | 177N |
| W = 700N (a Heavy Man is assumed) | 239N | 225N |

It would be preferable that the friction coefficient of the sitting surface has a sufficiently large value to prevent buttocks of the user from sliding on the sitting surface. As already mentioned, in the embodiment shown in FIGS. 1-3, the upper surface cover 8*a* and the lower surface cover 8*b* are taken by a measure to increase their values of the friction coefficients.

When it is assumed that no deformation of the sitting surface is allowed, the value of friction coefficient between the sitting surface 10 and the user's buttocks is needed to be larger than tan θ to prevent buttocks of the user from sliding on the sitting surface 10. In the case where the cushion has the tilt angle θ 20 degrees, it is needed that the friction coefficient has the value larger than about 0.37.

In the embodiment shown in FIGS. 1-3, an optimized value of depression or deformation of the upper member 4 having elasticity is generated due to the weight of the user so as to play an important role for preventing buttocks of the user from sliding on the sitting surface together with a friction force between the sitting surface 10 and buttocks of the user.

(Detailed Description about Hardness of the Upper Member 4)

Next, a preferable value of hardness of the upper member 4 will be explained in detail. When the hardness of the upper member 4 is too soft, the stretch assist cushion cannot work its inherent role because user's buttocks subside into the upper member 4. In contrast to this, when the hardness of the upper member 4 is too hard, a risk that the user's buttocks easily slide on the sitting surface would be increased.

According to test results obtained by performing tests in which a plurality of the examiners having difference in sex, age, physique and the like have tested a plurality of prototypes of the upper member 4, each of which having an individual value of hardness, it has been concluded that a preferable value of the hardness is within range from 200 N to 500 N defined by Japanese Industrial Standard JISK6400-2. Specifically, in a test piece which is formed to have the shape of square having a length of the edge of 380 mm in the top view and is 50 mm in thickness, it is preferable that, when the upper member is compressed such that its volume drops 25%, the upper member 4 has an enough value of hardness to generate the restoring force whose value is within range from 200 N to 500 N. In more detail, it has been seen that a preferable value of the hardness is within range from 350 N to 450 N defined by Japanese Industrial Standard JISK6400-2, when an ordinary adult uses the stretch assists cushion.

Similarly, when the value of impact resilience of the upper member 4 is too small, the stretch assist cushion cannot work its inherent role because user's buttocks subside into the upper member 4. In contrast to this, when the value of impact resilience of the upper member 4 is too large, a risk that the user's buttocks easily slide on the sitting surface would be increased. According to the test results, it has been seen that it is preferable the upper member has the value of the impact resilience within range from 20 to 60% defined by Japanese Industrial Standard JISK6400-3.

In the tests mentioned above in which the plurality of prototypes of the upper member 4, each of which having an individual value of hardness, have been tested, when the user sits on a portion of the sitting surface near the crest thereof, a value of a depression of this portion of the sitting surface is estimated to be within range from to 30 mm. Specifically, it is considered that the hardness such that a depression length at a portion of the sitting surface near the crest thereof is within range from 10 to 30 mm will be preferable.

Figure 5:
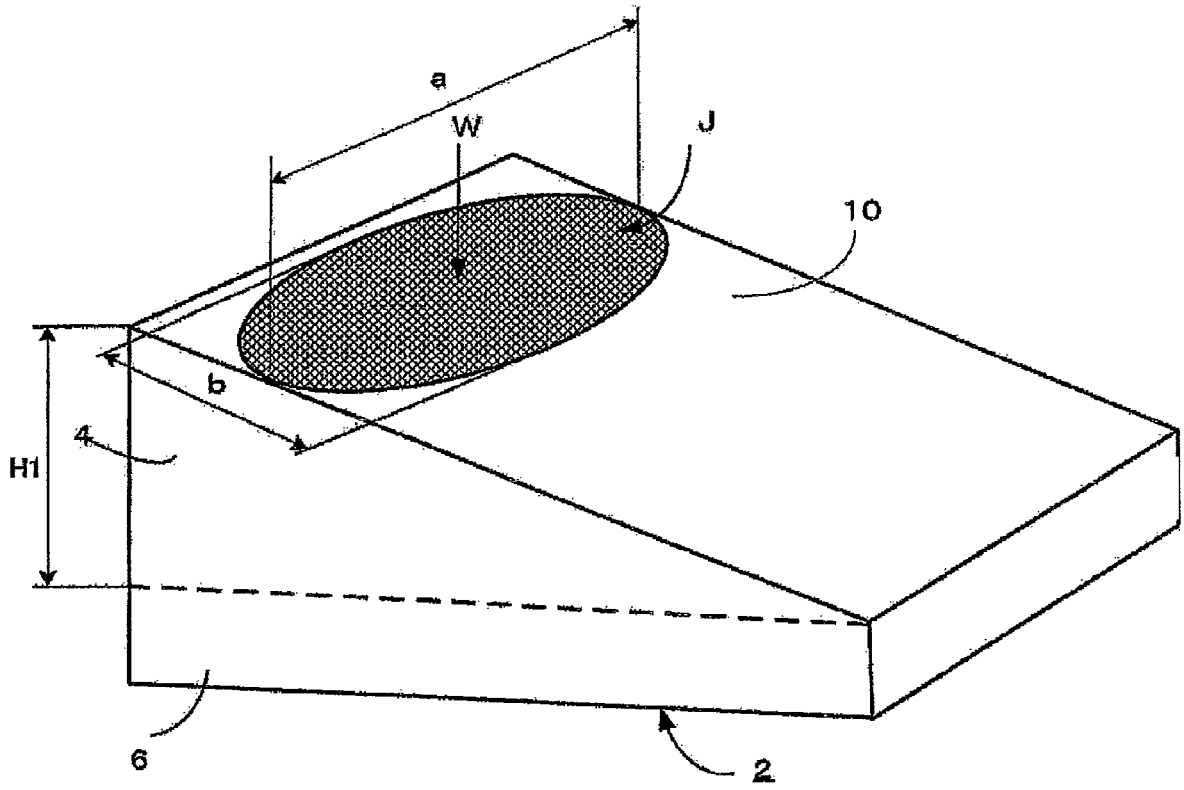
FIG. 5 is a schematic diagram theoretically illustrating an appropriate value of hardness of the stretch assist cushion according to the one embodiment of the present invention.

Next, a relationship between an appropriate value of hardness within range from 200 N to 500 N and an appropriate value of the depression length with in range from 10 mm to 30 mm will be theoretically discussed referring to FIG. 5.

It will be assumed that a hatched portion J in FIG. 5 is uniformly depressed by the load W which is generated by weight of the user and is applied to the upper member 4. Further, it will be assumed that the hatched portion J has the shape of ellipse having 400 mm in the major axis a and 300 mm in the minor axis b and having the area $J_A$ of the hatched portion J of 400×300×π=377,000 mm2. Further, in this case, compressive stress σ applied to the hatched portion J can be expressed as $W/J_A$.

If it is assumed an amount of the deformation (depression) of the upper member 4 is proportional to the value of the compressive stress σ when the volume of the upper member 4 drops at a percentage from 0% to 25%, strain ϵ can be expressed as σ/E, where E indicates a modulus of longitudinal elasticity. For example, when the upper member 4 has the value of the hardness of 300 N defined by Japanese Industrial Standard JISK6400-2, the value of the modulus of longitudinal elasticity E can be calculated as follows:

$$E = \sigma/\varepsilon$$

$$= 300\ \text{N}/(380\ \text{mm} \times 380\ \text{mm})/0.25$$

$$= 0.0083\ \text{N/mm2}.$$

Further, a displacement X can be obtained as ϵ×H1 where H1 indicates the maximum height of a wedge-shaped portion of the upper member 4 as shown in FIG. 5. For example, in the embodiment shown in FIGS. 1-3, the maximum height of the wedge-shaped portion of the upper member 4 is calculated as 400 mm×tan 20°=about 150 mm.

In cases where each of cushions has a corresponding one of values of the hardness of 200 N, 300 N, 400 N, and 500 N defined by Japanese Industrial Standard JISK6400-2, when it is presumed that the value of the load W of a typical woman will be 400 N, that of a typical man will be 550 N, and that of a heavy man will be 700 N, respective values of the displacement X of the sitting surface near the crest of the upper member will be calculated as shown in Table 2.

TABLE 2

| Hardnes of the | Modulus of Longitudinal | W = 400N (A Typical Woman is assumed) σ = 0.0011N/mm² | |
|---|---|---|---|
| Upper Member (JIS K6400-2) | Elasticity E (N/mm²) | Compressive Stress ϵ | Displacement X (mm) |
| 200N | 0.0055 | 0.19 | 29 |
| 300N | 0.0083 | 0.13 | 19 |
| 400N | 0.011 | 0.10 | 14 |

TABLE 2-continued

| Hardnes of the Upper Member (JIS K6400-2) | Modulus of Longitudinal Elasticity E ($N/mm^2$) | W = 550N (A Typical Man is assumed) $\sigma = 0.0015N/mm^2$ Compressive Stress $\epsilon$ | Displacement X (mm) |
|---|---|---|---|
| 200N | 0.0055 | 0.26 | 39 |
| 300N | 0.0083 | 0.18 | 26 |
| 400N | 0.011 | 0.13 | 20 |
| **Hardnes of the Upper Member (JIS K6400-2)** | **Modulus of Longitudinal Elasticity E ($N/mm^2$)** | **W = 700N (A Heavy Man is assumed) $\sigma = 0.0019N/mm^2$ Compressive Stress $\epsilon$** | **Displacement X (mm)** |
| 200N | 0.0055 | 0.34 | 50 |
| 300N | 0.0083 | 0.22 | 34 |
| 400N | 0.011 | 0.17 | 25 |

Analyzing results shown in Table 2, in the case where the upper member 4 has the value of the hardness within range from 200 N to 500 N defined by Japanese Industrial Standard JISK6400-2, when the typical woman (W=400 N) sits on it, the value of the strain $\epsilon$ falls within range from 0.08 to 0.19, and the value of the displacement X falls within range from 12 mm to 29 mm. Therefore, when the upper member 4 has the value of the hardness of 500 N, the user may feel that the upper member 4 is a little harder than a proper one. However, in almost all cases where the upper member 4 has the value of the hardness within range from 200 N to 500 N, it is considered that the value of the strain $\epsilon$ falls within range defined as one in which the cushion has the value of hardness to bring a suitable elasticity, and the value of the displacement X falls within range in which the user can obtain a "good feelings for fitting the buttocks" such that buttocks of the user will not slide on the sitting surface and will not subside into the upper member too much.

In the case where the typical man (W=550 N) sits on the cushion, the value of the strain $\epsilon$ falls within range from 0.14 to 0.34, and the value of the displacement X falls within range from 21 mm to 51 mm. Therefore, it is considered that, when the upper member 4 has the value of the hardness of 200 N (the displacement X=50 mm) or of 300 N (the displacement X=34 mm), the depression length is too large so that the user would feel that the upper member 4 is too soft. However, in other cases, it is considered that the value of the strain $\epsilon$ falls within range defined as one in which the cushion has the value of hardness to bring a suitable elasticity, and the value of the displacement X falls within range in which the user can obtain a "good feelings for fitting the buttocks" such that buttocks of the user will not slide on the sitting surface and will not subside into the upper member too much.

Further, in the case where the heavy man (W=550 N) sits on the cushion, the value of the strain $\epsilon$ falls within range from 0.11 to 0.26, and the value of the displacement X falls within range from 16 mm to 39 mm. However, in other cases, it is considered that the value of the strain $\epsilon$ falls within range defined as one in which the cushion has the value of hardness to bring a suitable elasticity, and the value of the displacement X falls within range in which the user can obtain a "good feelings for fitting the buttocks" such that buttocks of the user will not slide on the sitting surface and will not subside into the upper member too much.

Next, a more appropriate range of the value of the hardness of the cushion appropriate for any type of users whose physical conditions have been mentioned above will be calculated in range from 200 N to 500 N defined by Japanese Industrial Standard JISK6400-2. Specifically, in the case where the value of the hardness within range from 350 N to 450 N, the value of the strain $\epsilon$ falls within range from 0.09 (in the case of the typical woman) to 0.19 (in the case of the heavy man), and the value of the displacement X falls within range from 13 mm (in the case of the typical woman) to 29 mm (in the case of the heavy man). Thus, when range from 350 N to 450 N is chosen as the more appropriate range of the value of the hardness of the cushion, the value of the strain $\epsilon$ may drop at most 25%, and the value of the displacement X falls within range from 10 mm to 30 mm. Those limiting values can be considered to be appropriate. Therefore, when the value of the hardness of the cushion is selected among range from 350 N to 450 N, it has been theoretically concluded that the user can obtain a suitable elasticity, and a "good feelings for fitting the buttocks" such that buttocks of the user will not slide on the sitting surface and will not subside into the upper member too much.

(Description about a Preferable Value of the Depression Length Depending on the Level of the Sitting Surface)

In the stretch assist cushion 2 according to the present invention, the user can choose a portion of the sitting surface 10 at which the user sits to adjust the value of the level of the sitting surface as a desired value to comfortably do stretching exercises. For example, in the embodiment shown in FIGS. 1-3, the user can choose the desired value of the level of the sitting surface among values within range from 50 mm to 200 mm. In this case, there is a remarkable feature, that is, a preferable value of the depression length of the sitting surface which to be desired by the user may depend on the value of the level at which the buttocks of the user is positioned when the user sits on the sitting surface.

When the user sits on a portion of the sitting surface 10 near the lowest point thereof, a difference in level between the floor and the portion of the sitting surface 10 is small so that, when the depression length caused by the weight of the user is large, the user tends to feel that the level of the portion of the sitting surface is too low to perform the stretch assist. Therefore, in this case, it is preferable that the user feels that the depression length should be small, that is, the value of the hardness of the cushion should be relatively hard.

In contrast to this, when the user sits on a portion of the sitting surface 10 near the highest point thereof, a difference in level between the floor and the portion of the sitting surface 10 is large so that, when the depression length caused by the weight of the user is small, the user tends to feel a fear that the buttocks of the user slides on the sitting surface. Therefore, in this case, it is preferable that the user feels that the depression length should be large, that is, the value of the hardness of the cushion should be relatively soft.

In the embodiment shown in FIGS. 1-3, because the upper member 4 is made of a material in which every portion of the material have the same value of elasticity, when all portions of the sitting surface are subjected to a given value of the load W, the depression length of each portion of the sitting surface will increase substantial linearly with increase of the level of the sitting surface. In the same way, the depression length of each portion of the sitting surface will decrease substantial linearly with decrease of the level of the sitting surface. Further, because the upper member 4 is configured to have the shape of wedge having a constant value of the tile angle $\theta$ regardless of the portion of the sitting surface, the level of the sitting surface will increase substantial linearly as approaching the rear end of the cushion from the front end. In the same way, the level of the sitting surface will decrease substantial linearly as approaching the front end of the cushion from the rear end.

As discussed above, in the embodiment shown in FIGS. 1-3, the user feels that the cushion is relatively hard when the user sits on a portion of the sitting surface near the lowest level of the cushion, while the user feels that the cushion is relatively soft, when the user sits on a portion of the sitting surface near the highest level of the cushion. Therefore, it is possible to provide a stretch assist cushion 2 with which the user can obtain a good feeling and handling easiness.

(Detailed Description about the Level H of the Lowest Point of the Sitting Surface)

As discussed above, the user can choose the value of the level of the sitting surface 10 as the mostly optimized value of the level of buttocks of the user at which the user can do leg-split type stretching exercises. For example, in the embodiment shown in FIGS. 1-3, the user can choose the value of the level of the sitting surface among ones within range from 50 mm to 200 mm. Therefore, it is possible that the upper member 4 is configured to have an appropriate value of the tile angle θ and an appropriate value of the level H of the lowest point of the sitting surface 10 so as to realize the most important condition for assisting for doing leg-split type stretching exercises, that is, the condition where pelvis of the user can easily tend to be inclined forward and buttocks of the user can be kept at a high level.

In the stretch assist cushion 2 in which the shape is not trapezoid but triangle in the side view, that is, (that is, the stretch assist cushion 2 is consisted of only the wedge-shaped upper member 4), when the user sits on a portion of the sitting surface 10 near the front end of cushion 2, the value of the level of buttocks of the user from the floor becomes almost zero so that the stretch assist cushion 2 cannot have a function of assisting the user to doing stretching exercises. Further, even when the user sits on a portion of the sitting surface 10 located a little bit apart from the front end of cushion 2, the level of buttocks of the user from the floor is reduced due to deformation of the cushion 2 induced by the weight of the user so as to have the value of almost zero because the upper member 4 is made of the material having elasticity.

Therefore, the sitting surface of the cushion can have a certain level even when the user sits on the portion of the sitting surface 10 near the front end of cushion 2 by making the cushion configured to have the shape of trapezoid in the side view and to include not only the upper member 4 made of the first material but also the lower member 6 made of the second material being harder than the first material, as in the case of the stretch assist cushion 2 according to the present invention.

According to test results obtained by performing tests in which a plurality of examiners having difference in sex, age, physique and the like, have used a plurality of prototypes of the upper member 4, each of which has an individual value of the level H of the lowest point of the sitting surface 10, there are some situations in which it would be preferable to be considered that the cushion should be sized such that the level H of the lowest point of the sitting surface 10 is equal to or greater than 5 mm, equal to or greater than 15 mm, or equal to or greater than 30 mm, and the maximum level H of the lowest point of the sitting surface 10 is equal to or less than 100 mm, equal to or less than 150 mm, or equal to or less than 200 mm.

Next, a preferable value of the level H of the lowest point of the sitting surface will be theoretically explained. As already discussed, in the embodiment shown in FIGS. 1-3, because the sitting surface 10 is tilted to have the tilt angle θ of 20 degrees relative to the floor, the level of the lowest point of the sitting surface can be controlled to have a desired value within range from 50 mm to 200 mm.

However, the user may meet a situation where the user has to sit on the portion of the sitting surface near the lowest point of the sitting surface, i.e., near the front end of the stretch assist cushion 2 to do some kinds of the stretching exercises. The value of the level H of the lowest point of the sitting surface 10 is needed to be chosen such that even in this situation, the user can do the stretching exercises effectively.

According to test results obtained by performing tests for a plurality of examiners and to empirical facts, it is considered the cushion 2 should be configured such that an altitude angle or a solar elevation angle between the user's leg and the floor should be at least about 3 or degrees to allow the user to do stretching exercises more effectively than a case where the user directly sits on the floor.

Figure 6:
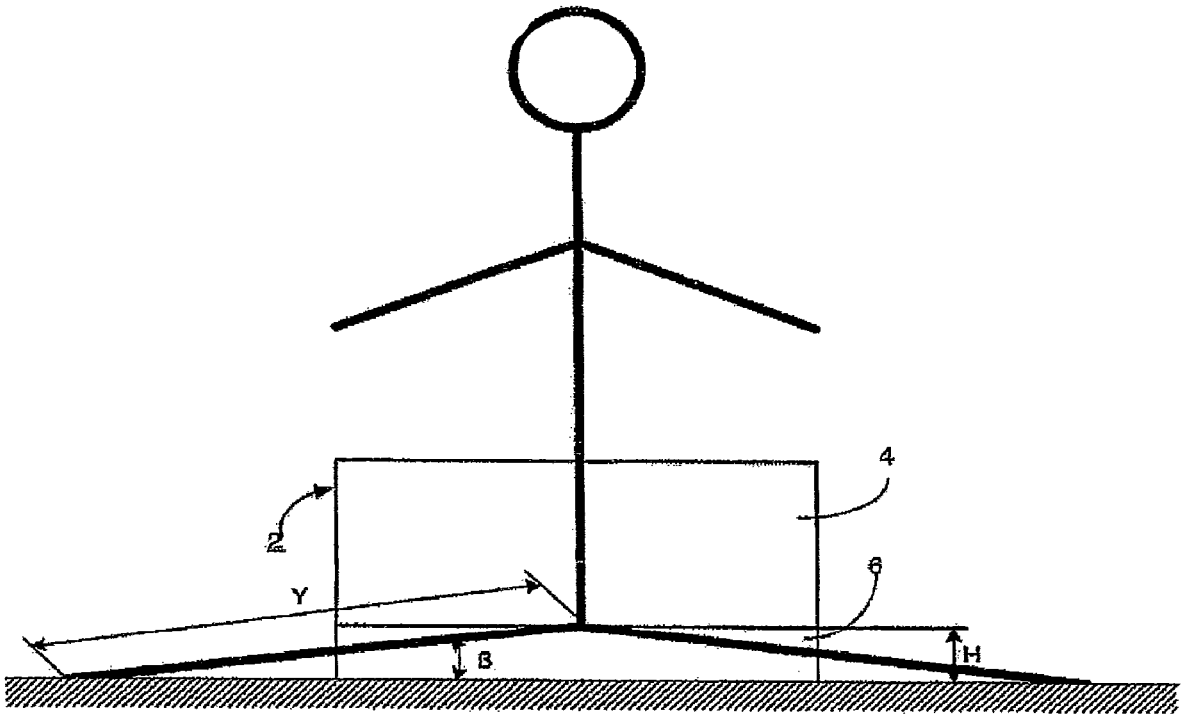
FIG. 6 is a schematic diagram theoretically illustrating an appropriate level H of the lowest point of a sitting surface of the stretch assist cushion according to the one embodiment of the present invention.

The reasons for the empirical facts will be explained below referring to FIG. 6. When the altitude angle which is needed to be more than about 3 or 6 degrees is denoted by β, and a length of one of the user's legs is denoted by Y, the preferable value of the level H of the lowest point of the sitting surface can be written as follows:

$$H=Y\times\sin\beta\ (\beta=3°\sim6°)$$

Further, when the height of the user is denoted by L, it is generally said that there is a relationship between the height L and the length of the legs Y:

$$Y=0.4\sim0.5\times L$$

Hence, the preferable value of the level H of the lowest point of the sitting surface would fall within range:

$$H=0.4\times L\times\sin 3°\sim0.5\times L\times\sin 6°$$

Here, it will be assumed that the height L is within range from 1400 mm to 1900 mm, the preferable value of the level H of the lowest point of the sitting surface can be calculated as:

$$H=29.3\text{ mm}\sim99.3\text{ mm}.$$

Therefore, it is theoretically concluded that the preferable value of the level H of the lowest point of the sitting surface should fall with range substantially from 30 mm to 100 mm.

In contrast to the above discussions in which ranges of the values of altitude angle β have been limited to ranges from 3 degrees to 6 degrees and the height L to range from 1400 mm to 1900 mm, respectively, there would be cases in which wider ranges of the values of altitude angle β and the height L would be needed to be accepted. In these cases, it is considered to be theoretically shown an evidence that the lower limited value of the level H of the lowest point of the sitting surface should equal to and greater than 5 mm or 15 mm, and the upper limited value of the level H of the lowest point of the sitting surface should equal to and smaller than 150 mm or 200 mm. For example, when more flexible persons and more persons such as children would be taken into the consideration, there may exist a case in which it is theoretically shown an evidence that the preferable value of the level H of the lowest point of the sitting surface should fall within range from 5 mm to 100 mm.

(Description of the Other Embodiments of the Stretch Assist Cushion According to the Present Invention)

Next, referring to FIG. 7-9, other embodiments of the stretch assist cushion will be explained.

(Embodiments Including Upper Member 4 and Lower Member 6 Having Different Shapes)

First, the stretch assist cushion 2 that includes the upper member 4 and the lower member 6 which have different shapes from those of the previous embodiment shown in FIG. 1-3 will be explained as an embodiment according to the present invention.

In the embodiment shown in FIG. 1-3, the upper member 4 has the shape of wedge which can determine the tilt angle in the side view, and the lower member 6 has the shape of rectangular in the side view with non-tilted surface. Conversely to the previous embodiment, in an embodiment shown in FIG. 7*a*, the upper member 4 has the shape of rectangular in the side view with non-tilted surface, and the lower member 6 has the shape of wedge which can determine the tilt angle in the side view. Further, in an embodiment shown in FIG. 7*b*, both of an upper member 4 and a lower member 6 have the shape of wedge which can determine the tilt angle in their side views.

Figure 7A:
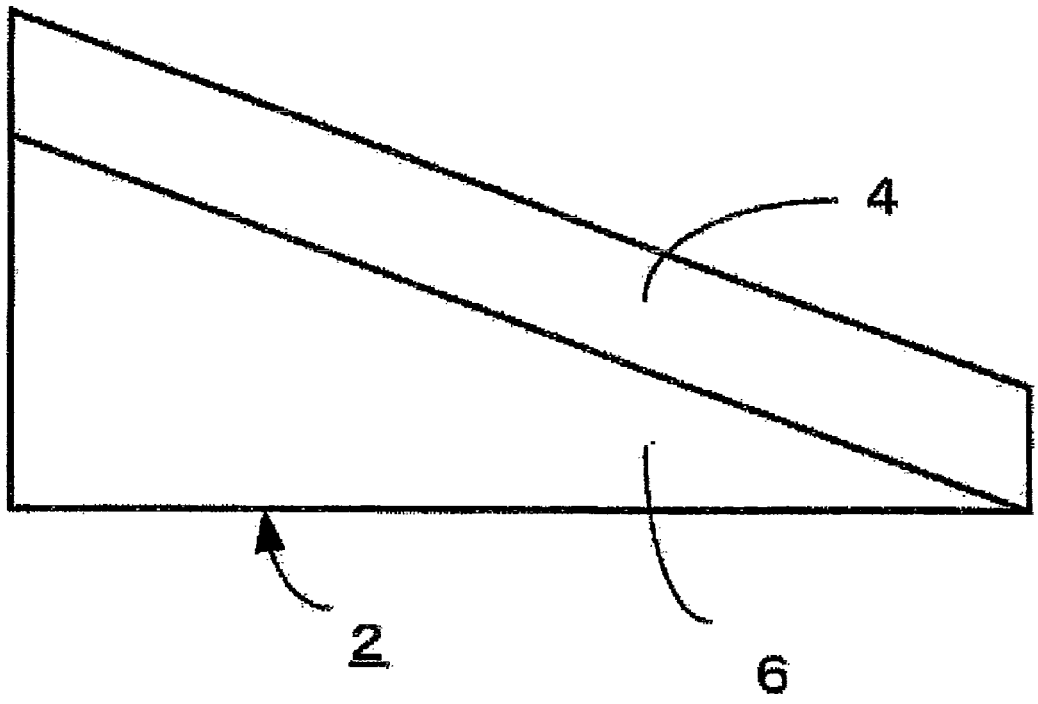
FIG. 7*a* is a schematic diagram showing another embodiment of the present invention.

In the embodiment shown in FIG. 7*a*, because the upper member 4 has the shape of rectangular in the side view with non-tilted surface, when whole of the upper member 4 would be made of one material and the lower member 6 would be made of another material harder than that of which the upper member 4 is made, values of depression length of each portion of the sitting surface (i.e., a value of deformation of the sitting surface) will be substantial equal each other. In the embodiment shown in FIG. 7*b* in which, when the level of the sitting surface from the floor increases, the value of the depression length (i.e., a value of deformation of the sitting surface) increases substantially proportionally with the increase of the level of the sitting surface. However, degree of depression in the embodiment shown in FIG. 7*b* is smaller than that in the embodiment shown in FIGS. 1-3.

Figure 7B:
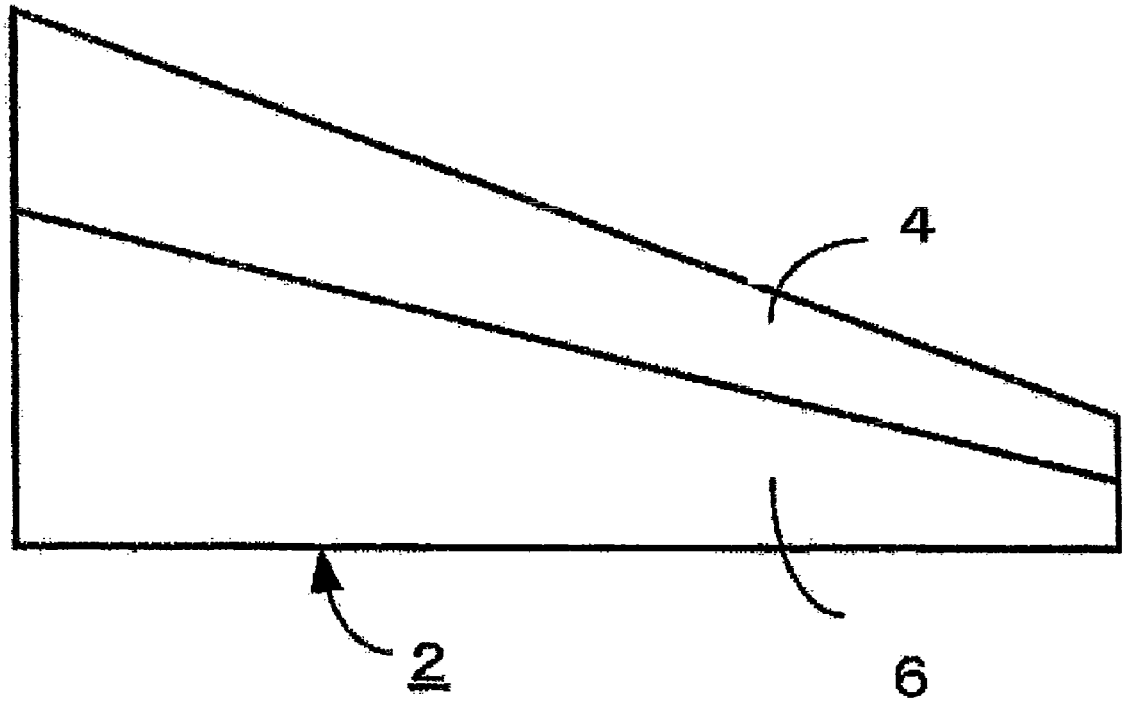
FIG. 7*b* is a schematic diagram showing another embodiment of the present invention.

Further, it is possible to obtain a distribution of the values of the depression lengths in the embodiments shown in FIGS. 7*a* and 7*b* similar to the distribution in the embodiment shown in FIGS. 1-3 by changing hardness of portions of the upper member 4.

(Description of an Embodiment Including Upper Member 4 that Provides with Means for Changing the Value of the Hardness of the Stretch Assist Cushion)

Figure 8:
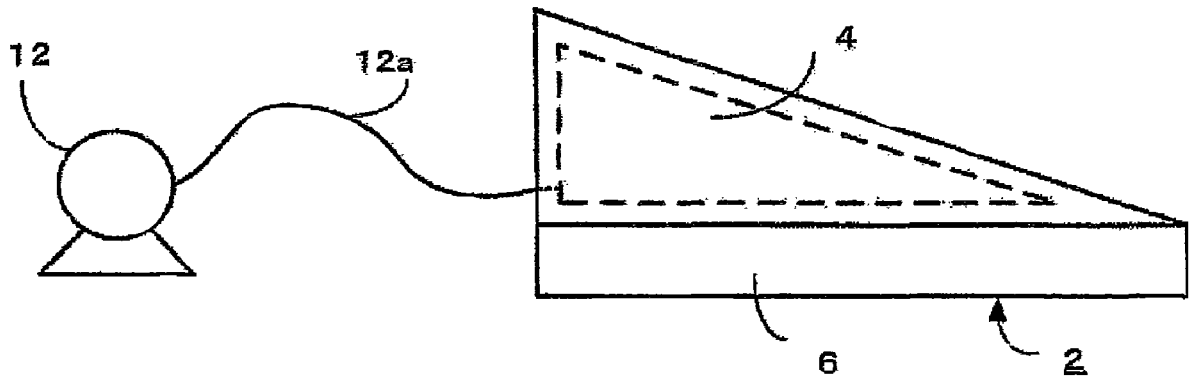
FIG. 8 is a schematic diagram showing a stretch assist cushion according to another embodiment of the present invention, the stretch assist cushion being provided with means for changing the value of hardness of an upper member.

Next, referring to FIG. 8, an embodiment of a stretch assist cushion 2 that includes the upper member 4 that has means for changing the value of the hardness of the stretch assist cushion 2.

In the embodiment shown in FIG. 8, the upper member is designed to have an interior cavity to which compressed air can be introduced from an air compressor 12 via an air hose 12*a*. Hence, it is possible to obtain the upper member 4 that is capable of adjusting the value of hardness thereof to a desired value by controlling air pressure in the cavity of the upper member 4. It may be allowed that without using any additional device such as the air compressor, the interior cavity could be filled with air in one manner in which some person breaths air into the interior cavity or in another manner in which a foot pump is used to introduce air into the interior cavity. Further, fluid with which the interior cavity is filled would not limit to air. It would be allowed that not only any gas including a rare gas such as nitrogen, argon and the like, but also any liquid including water can be used as the fluid with which the interior cavity would be filled.

Although, in the present embodiment, only the upper member 4 is provided with the means for changing the value of the hardness of the stretch assist cushion 2, it would be allowed that the lower member 6 is also provided with the same means for changing the value of the hardness of the stretch assist cushion 2. Further, it would be allowed that, instead of the upper member 4, only the lower member 6 is provided with the means for changing the value of the hardness of the stretch assist cushion 2. Further, it would be possible to change the value of hardness of the cushion by a technique in which two means, that is, means for changing the value of the hardness using air and means for changing the value of the hardness using a foam constituted of a synthetic resin are combined each other. A normal foam, a flexible foam, or their mixture can be used as the foam when the technique is adopted. Hence, value of hardness may be adjusted by mixing the air and the foam in an interior cavity of the lower member 6 to one suitable for conditions of the user and of use of the cushion so that the user can comfortably do stretching exercises. Further, it can be considered that the interior cavity is filled with a gel-type material having the value of hardness depending on its temperature. However, it is allowed to use any one of methods for changing the value of the hardness of the stretch assist cushion.

(Description of an Embodiment Including Means for Changing Level of the Lowest Point of the Sitting Surface)

Next, referring to FIG. 9, an embodiment of the stretch assist cushion 2 that includes means for changing the value of level of the lowest point of the sitting surface from the floor will be explained.

Figure 9:
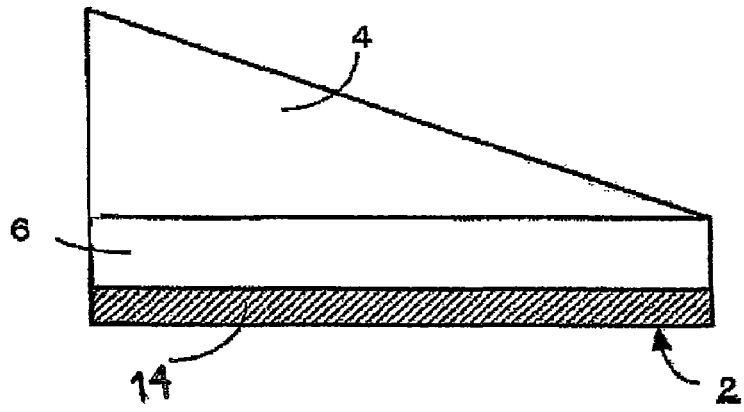
FIG. 9 is a schematic diagram showing a stretch assist cushion according to another embodiment of the present invention, the stretch assist cushion being provided with means for changing a level H of the lowest point of a sitting surface of the stretch assist cushion.

In the embodiment shown in FIG. 9, an adjustor 14 that adjusts the value of level of the lowest point of the sitting surface to a predetermined one is detachably joined to a bottom surface 12 of the stretch assist cushion 2. A manner by which the adjustor 14 is joined to the bottom surface 12 is exemplified by that in which a reusable adhesive tape which is made of cloth like a pile, and cloth having a string formed in shape of crochet hock, and the like. However, other possible manners can be accepted as manner for detachably joining the adjustor 14 to the bottom surface 12.

For example, the user can prepare and use several adjustors which have individual values of thickness different from each others to control the height of the lowest point of the sitting surface. Further, more than two adjustors can be stacked to use for controlling the value of the lowest point of the sitting surface.

Due to such the configuration, value of the level H of the lowest point of the sitting surface can always be adjusted to an optimum one that is determined by physique of the user and/or flexibility of the user.

Further, means for changing value of the level H of the lowest point of the sitting surface would not be limited to the above mentioned embodiments. When the lower member 6 has an interior cavity therein, it is allowed that the interior cavity of the lower member 6 is occupied with an amount of fluid to change the height of the lowest point of the sitting surface. Further, it is allowed that the stretch assist cushion is provided with a further adjustor that mechanically adjusts value of the level of the lowest point of the sitting surface to a predetermined one. However, other possible means can be accepted as means for changing value of the distance between the floor and the lowest point of the sitting surface.

Other Embodiments

Figure 10:
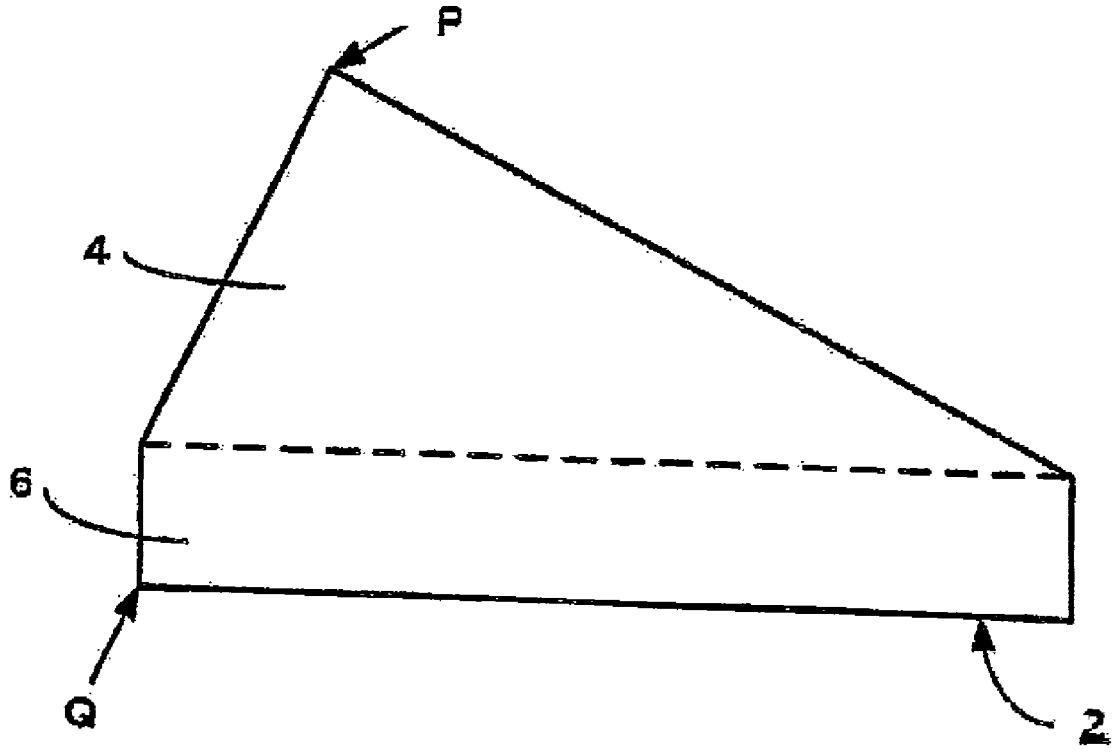
FIG. 10 is a side elevational view of the stretch assist cushion according to another embodiment of the present invention, in which a crest of a sitting surface is located at a position before a rear end of the cushion.

Other embodiments of a stretch assist cushion according to the present invention would be allowed, for example, a cushion having the shape shown in FIG. 10 in a side view may be considered to be allowed. In the cushion shown in FIG. 10, the crest P of the tilted sitting surface is not positioned at the same position at a rear end Q of the cushion, but before the rear end Q of the cushion.

In the case where the stretch assist cushion is used to do stretching exercises, the user usually sits on the cushion such that the back of the user faces the direction along which the level of the tilted sitting surface of the cushion increases.

When a small-sized cushion suitable for children, boys and girls, or women (for example, a cushion sized to have 300 mm in length and 325 mm in width) and the crest of the sitting surface is positioned at the same point in length with the rear end of the cushion, as shown in FIG. 2, there may be some potential risk that the user will fall back. In such the case, as shown in FIG. 10, the cushion can be designed to position the crest P of the sitting surface before the rear end Q of the cushion so that the user can sits on a portion of the sitting surface near its crest P while it is ensured to prevent the user from falling back. Therefore, in the cushion according to the present embodiments shown in FIG. 2*a* or 10, the most suitable shape of the cushion is allowed to be selected from several ones depending on a size of the cushion, conditions of use of the cushion, and the like.

A stretch assist cushion according to the present invention would not be limited to those according to the above mentioned embodiments, but is allowed to be adopted by any other possible embodiments. Further the stretch, assist cushion according to the present invention can be used to do stretching exercises not only for stretching their body portions including hip joint, but also for stretching their other portions such as backbone, hipbone, cervical spine, and the like.

(Description of Test Results Using the Stretch Assist Cushion 2)

Next, test results obtained by performing tests in which a plurality of examiners do leg-split type stretching exercises using various types of stretch assist cushions including the stretch assist 2 according to the present invention will be shown below. In these tests, the examiners have been used stretch assist cushions having configurations shown in FIG. 3 (Samples 1 to 4) and no stretch assist cushion (Sample 5) to do leg-split type stretching exercises.

TABLE 3

TEST CONDITIONS

| Cushion | CONDITIONS IN DOING STRETCHING | Material of which upper member is made | Material of which lower member is made |
|---|---|---|---|
| Sample 1 | Using the stretch assist cushion (embodiments shown in FIGS. 1-3) according to the present invention | Flexible form constituted of polyurethane | Flexible form constituted of polyurethane |
| Sample 2 | Using a conventional flat stretch cushion | Flexible form constituted of polyurethane | Flexible form constituted of polyurethane |
| Sample 3 | Using only upper member 4 (Level H = 0) | Flexible form constituted of polyurethane | — |
| Sample 4 | Using only lower member 6 (Tilt angl = 0) | — | Flexible form constituted of polyurethane |
| Sample 5 | Not using any cushion | — | — |

Ten examiners have their individual sexes and age as can be seen in the following table.

TABLE 4

SEXES AND AGES OF TEN EXAMINERS

| | Examiner 1 | Examiner 2 | Examiner 3 | Examiner 4 | Examiner 5 | Examiner 6 | Examiner 7 | Examiner 8 | Examiner 9 | Examiner 10 |
|---|---|---|---|---|---|---|---|---|---|---|
| Sex | Male | Female | Male | Male | Female | Male | Male | Female | Female | Female |
| Age | 64 | 60 | 59 | 35 | 40 | 40 | 34 | 36 | 19 | 18 |

Each of the examiners shown in table 4 has done leg-split type stretching exercise in the condition illustrated in table 3 to take data on distribution of values of splitting angle between legs, as shown in FIG. 5. When every examiner has done stretching exercises while sitting on a portion of the cushion near the rear end side.

TABLE 5

COMPARISONS BETWEEN VALUES OF SPLITTING ANGLE OF LEGS

| | Sample 1 | Sample 2 | Sample 3 | Sample 4 | Sample 5 |
|---|---|---|---|---|---|
| Examiner 1 | 102 | 88 | 85 | 84 | 78 |
| Examiner 2 | 104 | 96 | 93 | 99 | 88 |
| Examiner 3 | 116 | 103 | 101 | 106 | 98 |
| Examiner 4 | 102 | 90 | 88 | 88 | 85 |
| Examiner 5 | 118 | 115 | 107 | 102 | 100 |
| Examiner 6 | 110 | 107 | 103 | 103 | 98 |
| Examiner 7 | 149 | 141 | 138 | 140 | 133 |
| Examiner 8 | 145 | 140 | 142 | 144 | 138 |
| Examiner 9 | 121 | 112 | 110 | 121 | 121 |
| Examiner 10 | 130 | 122 | 124 | 119 | 111 |
| Average | 119.7 | 111.4 | 109.1 | 110.6 | 105.0 |

Unit [° (Degrees)]

As can be seen in the test results illustrated above, all the examiners have obtained their respective maximum values of the splitting angle of their legs when the stretch assist cushion according to the present invention has been used.

Further, when the examiners have done stretching exercises using the stretch assist cushion according to the present invention (i.e., in the case indicated by sample 1), the values of the splitting angle between legs have been improved by 14.7 degrees in average comparison with those in the case where no stretching cushion has been used (i.e., in the case indicated by sample 5). Further, when the examiners have done stretching exercises using the stretch assist cushion according to the present invention (i.e., in the case indicated by sample 1), the values of the splitting angle between legs have been improved by 9.3 degrees in average comparison with those in the case where the conventional stretching devices have been used (i.e., in the cases indicated by sample 2-4).

While it is impossible to take data in numerical terms, there has been obtained an evidence that every examiner has felt the most strong intensity of tension inside of their hip joint, and a significant effect of the stretching exercises. Further, effectiveness of the stretching exercises and handling easiness of the cushion have been examined at 5 levels by the ten examiners, as shown in table 6 below.

TABLE 6

EFFECTVINESS OF STRETCHING EXERCISES & HANDLING EASINESS

| | Sample 1 | Sample 2 | Sample 3 | Sample 4 | Sample 5 |
|---|---|---|---|---|---|
| Examiner 1 | 5 | 4 | 3 | 2 | 1 |
| Examiner 2 | 5 | 2 | 4 | 3 | 1 |
| Examiner 3 | 5 | 4 | 3 | 2 | 1 |
| Examiner 4 | 5 | 4 | 3 | 2 | 1 |
| Examiner 5 | 5 | 4 | 3 | 2 | 1 |
| Examiner 6 | 5 | 4 | 3 | 1 | 2 |
| Examiner 7 | 5 | 4 | 3 | 2 | 1 |
| Examiner 8 | 5 | 4 | 3 | 2 | 1 |
| Examiner 9 | 4 | 5 | 2.5 | 2.5 | 1 |
| Examiner 10 | 5 | 4 | 3 | 2 | 1 |
| Average | 4.90 | 3.90 | 2.95 | 2.15 | 1.10 |

5(BEST)~1(WORST)

As discussed above, according to the test results, it is proved that splitting angle between legs obtained in the case where the stretch assist cushion according to the present invention has been used is improved in comparison with those obtained in the case where a conventional flat mat has been used, and a significant effectiveness of stretching exercises can be obtained.

What is claimed is:

1. A stretch assist cushion for use while doing various types of stretching exercises including a stretching exercise for a user's body portion including a hip joint, said stretch assist cushion comprising:

an upper member that has an upper surface serving as a sitting surface in contact with the user's hip directly or through a covering member covering the upper member, the upper member being made of an elastic material; and a lower member that is located below the upper member and has a lower surface serving as a bottom surface of the cushion in contact with a floor directly or through a covering member covering the lower member, the lower member being made of a material harder than the material of the upper member, wherein, when the cushion is positioned such that the bottom surface is in contact with the floor, the sitting surface has a predetermined tilt angle relative to the floor, and the lower member serves to determine a predetermined distance between the floor and the lowest point of the sitting surface that has the predetermined tilt angle relative to the floor, and wherein the upper member has a rectangular or square top view shape, and a triangular side view shape, and the lower member has a rectangular or square top view shape, and a triangular or trapezoid side view shape.

2. The stretch assist cushion according to claim 1, wherein the predetermined tilt angle has a value within the range from 15 to 25 degrees.

3. The stretch assist cushion according to claim 1, wherein the upper member has a value of hardness within the range from 200 N to 500 N defined by Japanese Industrial Standard JISK6400-2.

4. The stretch assist cushion according to claim 3, wherein the upper member has a value of the hardness within the range from 350 N to 450 N defined by Japanese Industrial Standard JISK6400-2.

5. The stretch assist cushion according to claim 1, wherein the predetermined distance between the floor and the lowest point of the sitting surface that has the predetermined tilt angle relative to the floor has a value within the range from 5 to 100 mm.

6. The stretch assist cushion according to claim 1, wherein the upper member is made of a foam or a flexible foam constituted of a synthetic resin including polyurethane, rubber, or polypropylene.

7. The stretch assist cushion according to claim 1, wherein the upper member has a value of an impact resilience within the range from 20 to 60% defined by Japanese Industrial Standard JISK6400-3.

8. The stretch assist cushion according to claim 1, wherein, when the cushion is positioned such that the bottom surface is in contact with a floor, the crest of the sitting surface is located at a rear end of the cushion or at a position before a rear end of the cushion.

9. The stretch assist cushion according to claim 1, wherein the stretch assist cushion is sized so as to have 300 to 500 mm in length and 300 to 500 mm in width in the top view of the cushion.

10. The stretch assist cushion according to claim 1, wherein the sitting surface and/or the bottom surface is treated so as to increase the value of the friction coefficient thereof.

11. The stretch assist cushion according to claim 1, wherein, when the cushion is arranged such that the bottom surface is in contact with the floor and the same load is applied onto each portion of the sitting surface having a predetermined tilt angle relative to the floor, a depression value of a first portion located at a higher level from the floor than a second portion is larger than a depression value of the second portion.

12. The stretch assist cushion according to claim 11, wherein, when the same load is applied onto each portion of the sitting surface, the depression value of each portion of the sitting surface varies substantially proportionally with a difference of a level from the floor.

13. The stretch assist cushion according to claim 1, wherein the upper member has a hardness such that when the user sits on the cushion around the crest of the sitting surface having the predetermined tilt angle relative to the floor, a depression value is within the range from 10 to 30 mm.

14. The stretch assist cushion according to claim 1, wherein, when the height of the user is L, a predetermined distance between the floor and the lowest point of the sitting surface that has the predetermined tilt angle relative to the floor has a value within the range from $0.4 \times L \times \sin 3°$ to $0.6 \times L \times \sin 6°$.

15. The stretch assist cushion according to claim 1, further comprising:

means for changing the value of the hardness of the stretch assist cushion.

16. The stretch assist cushion according to claim 15, wherein an interior cavity of the upper member and/or an interior cavity of the lower member can be filled with air, and a value of the hardness of the cushion can be changed by adjusting a pressure of the filled air.

17. The stretch assist cushion according to claim 16, wherein a foam constituted of a synthetic resin is further inserted into the interior cavity of the upper member and/or the interior cavity of the lower member in addition to the air so as to change the value of the hardness of the cushion by combining the filled air with the foam in the interior cavity of the upper member and/or the interior cavity of the lower member.

18. The stretch assist cushion according to claim 1, further comprising:

means for changing a distance between the floor and the lowest point of the sitting surface having the predetermined tilt angle relative to the floor.

* * * * *

UNITED STATES PATENT AND TRADEMARK OFFICE

CERTIFICATE OF CORRECTION

PATENT NO. : 7,966,679 B2
APPLICATION NO. : 12/304402
DATED : June 28, 2011
INVENTOR(S) : Naoaki Sakata et al.

It is certified that error appears in the above-identified patent and that said Letters Patent is hereby corrected as shown below:

On the Title Page, Item [75] Inventors: First inventor's name should read --Naoaki--

Signed and Sealed this
Eighth Day of November, 2011

David J. Kappos

David J. Kappos
*Director of the United States Patent and Trademark Office*